US005178581A

United States Patent [19]

Del Monte

[11] Patent Number: 5,178,581

[45] Date of Patent: Jan. 12, 1993

[54] SMOKE EVACUATION SYSTEM

[76] Inventor: Ernest J. Del Monte, 909 Linden Ave., Rochester, N.Y. 14625

[21] Appl. No.: 649,746

[22] Filed: Feb. 1, 1991

[51] Int. Cl.[5] ..... F24F 7/007

[52] U.S. Cl. ..... 454/239; 454/252; 454/342

[58] Field of Search ..... 454/239, 252, 257, 335, 454/342

[56] References Cited

U.S. PATENT DOCUMENTS

| | | | |
|---|---|---|---|
| 4,058,253 | 11/1977 | Munk et al. | 454/342 X |
| 4,944,216 | 7/1990 | McCutchen | 454/342 |
| 5,033,360 | 7/1991 | Sacks | 454/239 |

FOREIGN PATENT DOCUMENTS

| | | | |
|---|---|---|---|
| 1465681 | 3/1989 | U.S.S.R. | 454/342 |
| 639519 | 6/1950 | United Kingdom | 454/342 |

*Primary Examiner*—Harold Joyce
*Attorney, Agent, or Firm*—Samuel R. Genca

[57] ABSTRACT

A smoke evacuation system for a building made of modular units includes sets of modular units disposed to each other and joined by a wall so as to allow a space between the modular units to define an air intake chamber. Each modular unit has a window which communicates with an air intake chamber. Each air intake chamber has an opening with an air intake fan. Each modular unit includes a chase with a window for exhausting air from the modular unit. The chases of the modular units are situated one to another so as to allow a continuous flow of air therethrough. A roof covers all of the modular units and air intake chambers, but has openings for the respective chases. Exhaust fans are mounted in said roof openings for exhausting air and smoke from said modular units. A smoke detector is installed in each chase to detect smoke in each corresponding modular unit and chase. Each smoke detector in each chase of each modular unit responds to the presence of smoke in its corresponding chase and modular unit, by closing its smoke detector electrical circuit, thereby causing its said air intake fan to operate so as to draw fresh air into the affected modular units and, by means of the exhaust fans, to remove smoke-filled air from the affected modular units and corresponding chases, that removal of smoke-filled air being done in a push and pull form of action.

4 Claims, 7 Drawing Sheets

SMOKE EVACUATION SYSTEM

BACKGROUND OF THE INVENTION

1. Field Of The Invention

The present invention relates to a smoke evacuation system and more particularly to a smoke evacuation system which is devoid of duct work and such other means of routing the smoke-filled air from the building.

2. Prior Art

In my prior art molding machine described in my U.S. Pat. Nos. 3,853,452, and 4,890,999, there is disclosed a novel molding machine for making modular units. The modular units are constructed in a manufacturing plant and then shipped to the building site whereon they are to be installed. The modular units can, for example, be placed in an inner circle with the inside corners of the modular units tangent to one another, while the outside corners of the modular units may be connected to an exterior wall segment or to an exterior wall to complete an outer circle on the outside walls. Another form of the building constructed with these modular units may be in the rectangular configuration, with the modular units placed end-to-end, with a small interval of space of each of the modular units thus used. As may now be seen the modular units can be installed in as many configuration as desired.

The modular units described herein, have heretofore found it necessary to use a great deal of duct work for their smoke evacuation systems. However, in the present smoke evacuation system the duct work is dispensed with, thereby greatly reducing construction costs and better ensuring the integrity of the completed structure. More particularly, the duct work provides avenues of escape in penal and restrictive institutions as well as unlawful means of entry to business and residential facilities, while most such drawbacks are missing from the present smoke evacuation system.

Accordingly, there still exists a pressing need for a novel smoke evacuation system which is inexpensive to manufacture, easy to operate and efficient in its use.

SUMMARY OF THE INVENTION

Briefly described, a smoke evacuation system for modular units includes an air intake chamber mounted contiguous to two modular units. The air intake chamber includes an exterior wall with an opening therein, which exterior wall forms a triangular configuration with the right wall of one modular unit being tangent to the left wall of another modular unit, to thereby define said triangular configuration. An outside wall fan is mounted in the opening of the exterior wall of the air intake chamber. The right wall of one modular unit and the left wall of another modular unit tangent to said right wall of said modular unit each include an open first window through which each communicates with the air intake chamber and the room modules. Each modular unit includes an inside wall which defines a chase area. Each inside wall includes an open second window communicating with the modular unit and the chase area. A roof covers each air intake chamber and said modular units including said chase areas. The roof includes a roof opening disposed over each chase area of each module. An exhaust fan is mounted in said roof opening for exhausting air and smoke therethrough. A smoke detector is installed in each chase area to detect smoke in the room modules and chase area. A smoke detector circuit is connected between the smoke detector and the outside wall fan and the exhaust fan. The smoke detector responds to the presence of smoke in the chase area and modular unit, by closing said smoke detector circuit, thereby causing said outside wall fan to operate so as to take fresh air into the modular units and, by means of the exhaust fan, to remove smoke-filled air from the room modules and chase area.

DESCRIPTION OF THE DRAWINGS

The invention, and all its species, both as to its organization and method of operation, will best be understood by reference to the following description taken in connection with the accompanying drawings, in which.

DETAILED DESCRIPTION OF THE PREFERRED EMBODIMENT

Figure 1:
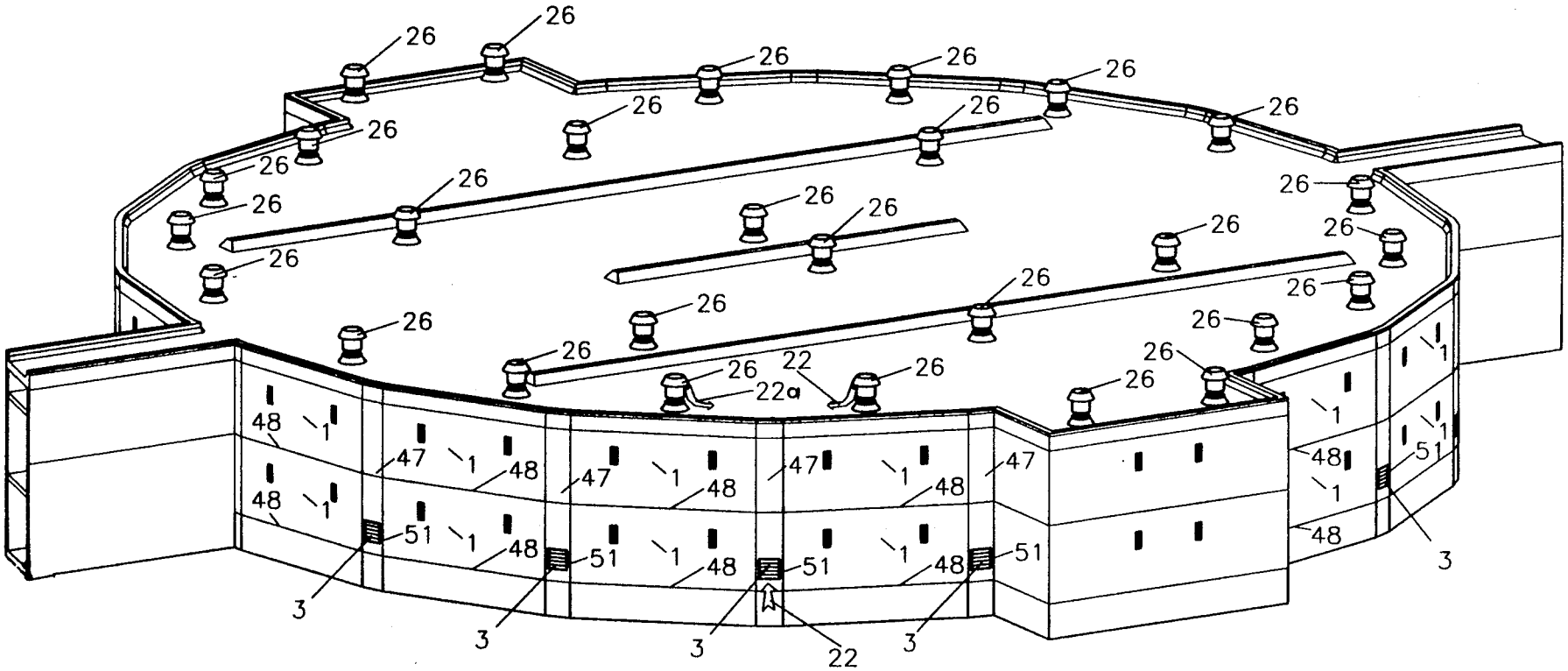
FIG. 1 is a perspective view of a prison complex which includes a smoke evacuation system in accordance with the invention.
Figure 2:
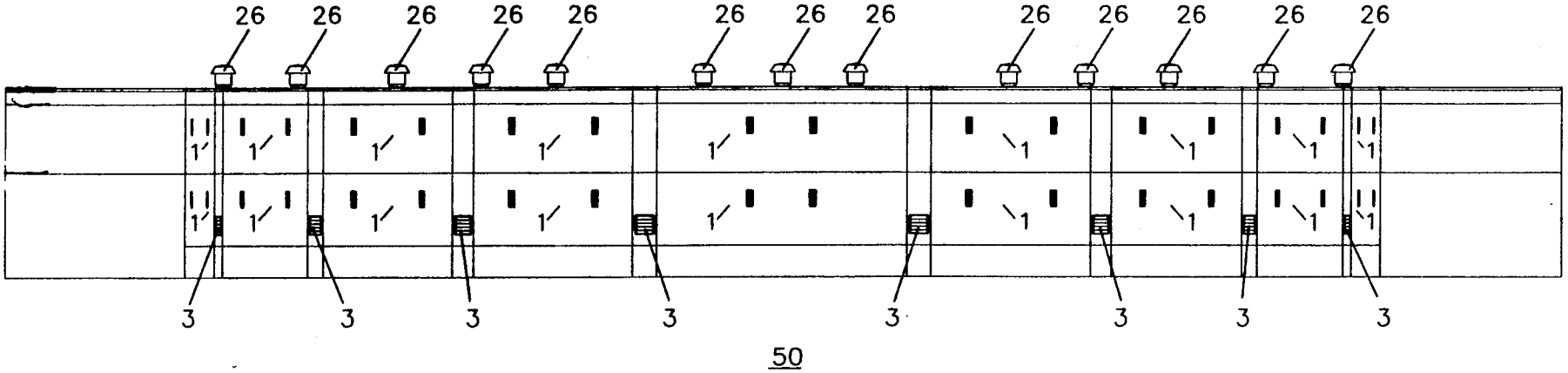
FIG. 2 is a side elevation of the prison complex, having a smoke evacuation system, as shown in FIG. 1.
Figure 3:
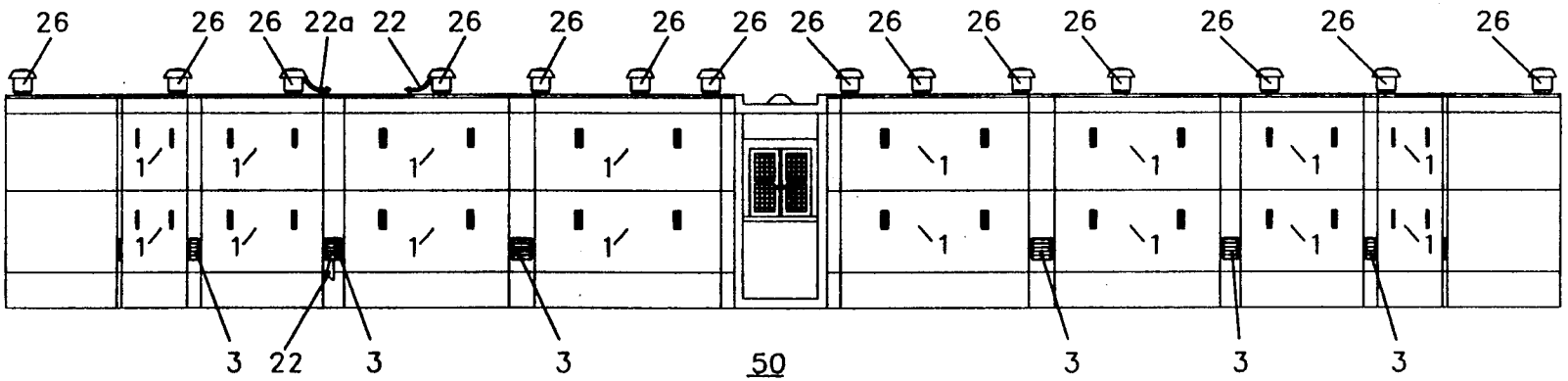
FIG. 3 is a front view of the prison complex, having a smoke evacuation system, as shown in FIG. 1 and FIG. 2.
Figure 4:
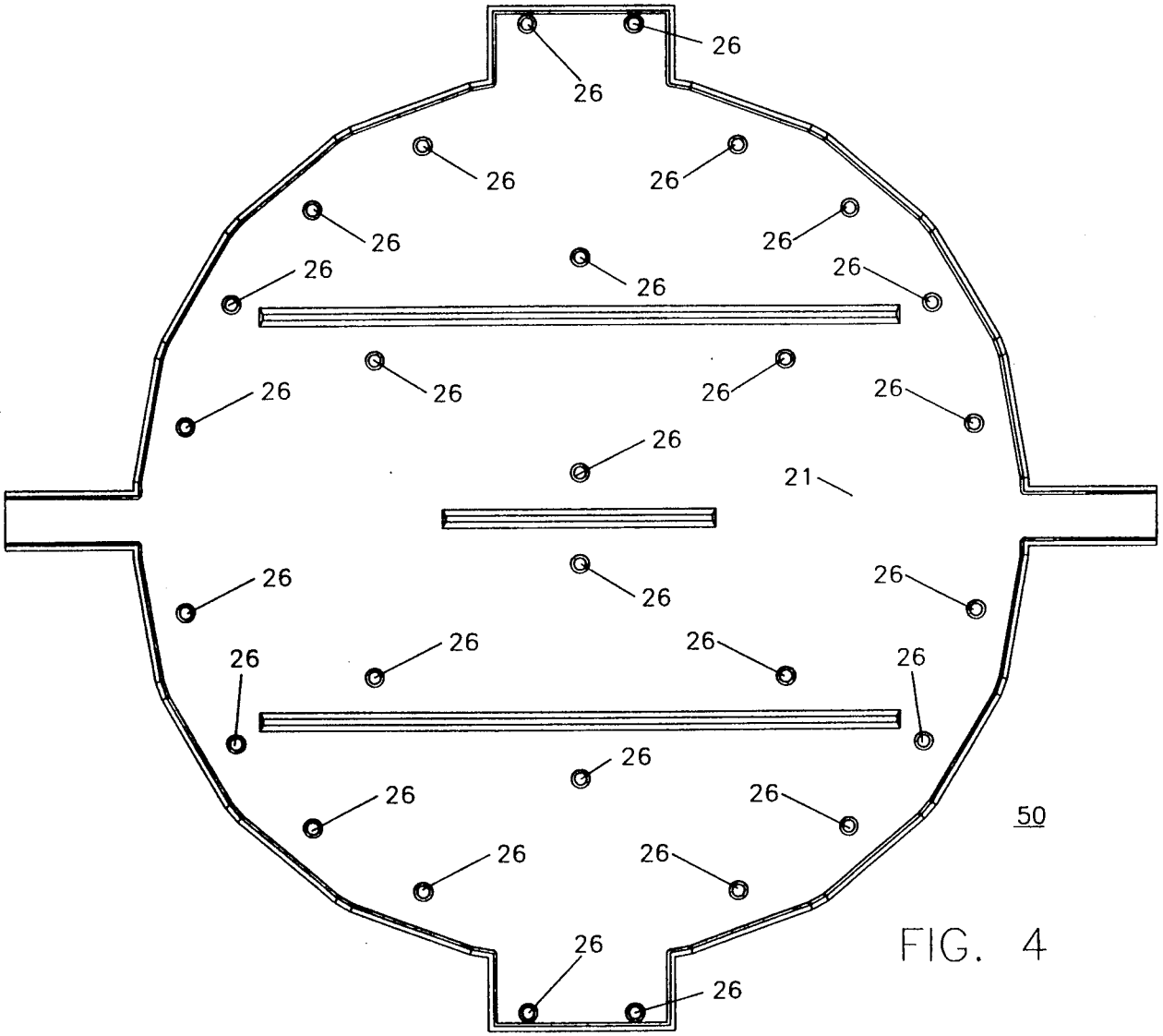
FIG. 4 is a plane view of the prison complex, having a smoke evacuation system.
Figure 5:
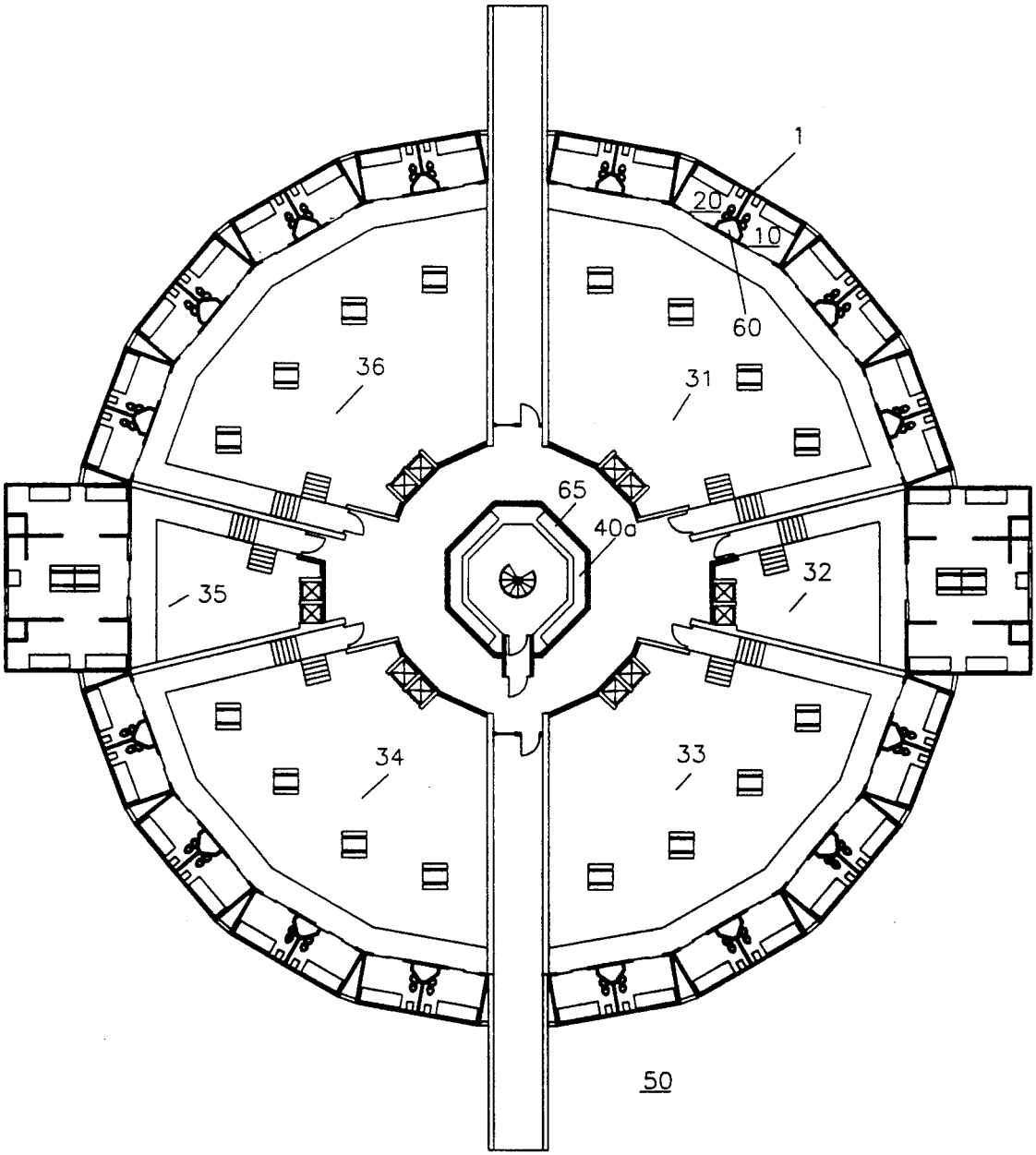
FIG. 5 is a floor plane view of the prison complex, having a smoke evacuation system, and which is divided into segments and includes modular units which are identical to each other.
Figure 6:
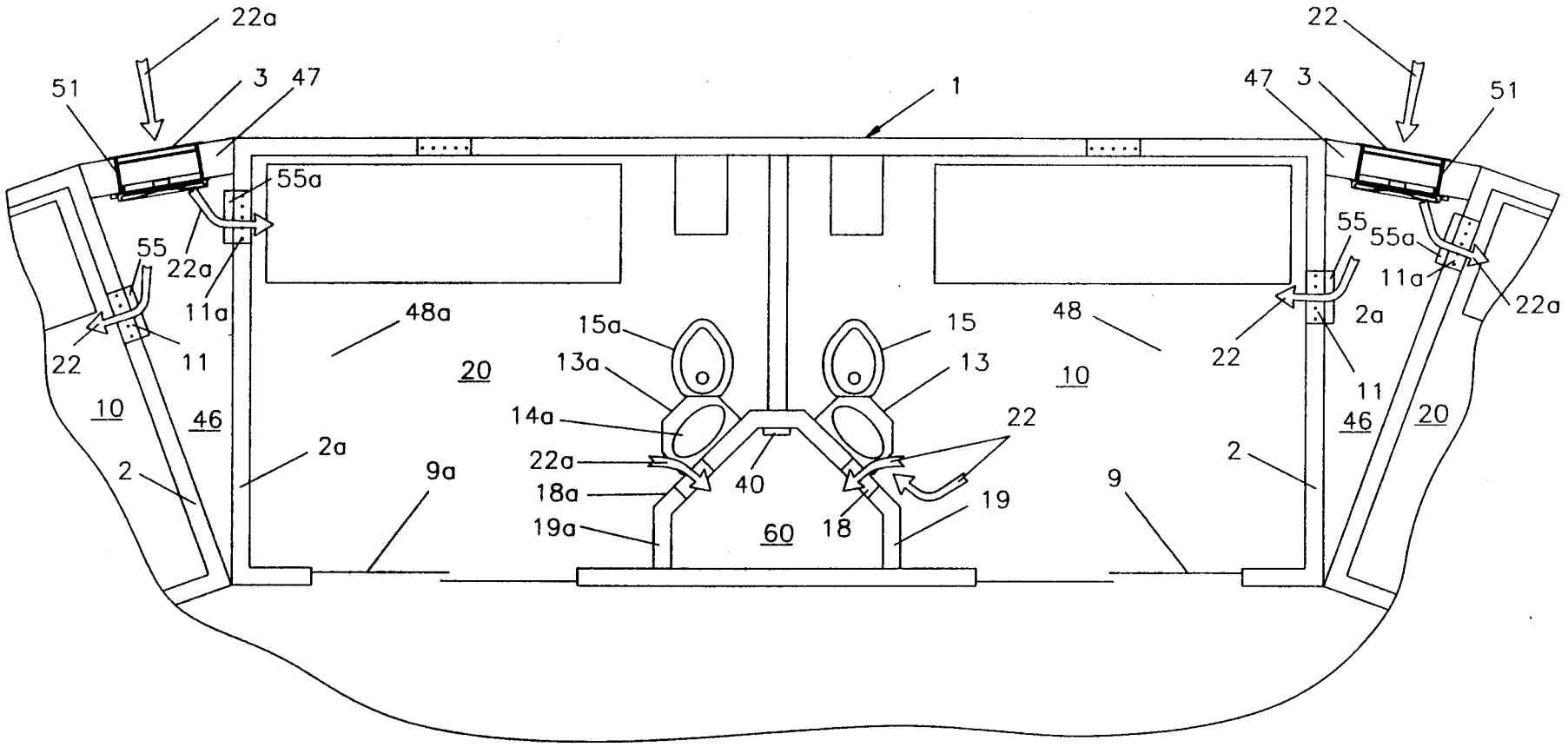
FIG. 6 is a partial, fragmentary, cross-sectional view of the prison complex's modular units, having a smoke evacuation system.

Referring to FIGS. 1–7 of the drawing, a 2-story prison complex 50 is shown. The prison complex 50 includes modular units 1, which are further divided into cell modules 10 and 20 as shown in FIG. 6. Each modular unit 1 is placed upon another modular unit 1 and all of the modular units 1 are disposed in a circular configuration. The modular unit 1 is preferably made of concrete and manufactured in a factory and is delivered to the prison site and is installed in place as aforesaid. The modular unit 1 includes a floor 48 and a floor **48*a* and integral walls 2 and 2*a* that are perpendicular to the floors 48 and 48*a* as shown in FIG. 6. The modular unit 1 is divided by a chase wall 19 in the center of the modular unit 1, thereby partitioning the modular unit 1 into cell module 10 and cell module 20. It should be understood that cell module 10 and cell module 20 are mirrored in design and, therefore, the numbers that refer to cell module 10 differ from the numbers that refer to cell module 20, by the small letter a, indicating thereby elements in cell module 20 that correspond to elements in cell module 10. The modular unit 1 and the cell modules 10 and 20 are mirror images of each other and, therefore each modular unit 1 is set forth throughout the prison complex 50**.

Figure 7:
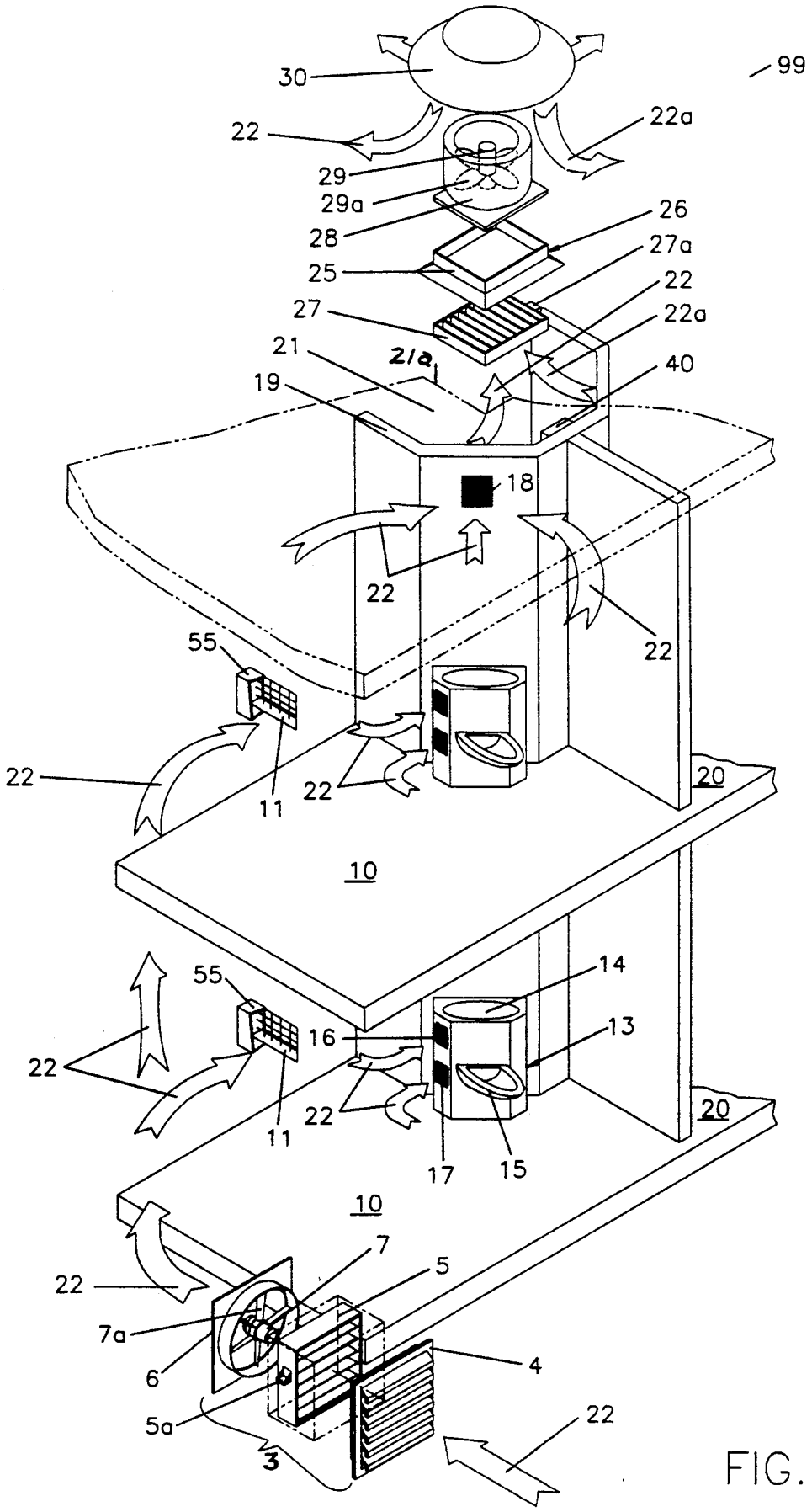
FIG. 7 is a fragmentary, isometric view of the smoke evacuation system servicing the modular units of the prison complex.

Referring to FIG. 6 and FIG. 7, an exterior wall 47 is fixed between the modular units 1 to define a pie-shaped air chamber 46. The exterior wall 47 includes a fan-opening 51. Mounted in the fan opening 51 is an exterior wall-mounted fan assembly 3. The exterior wall-mounted fan assembly 3 includes a shield 4, a motorized damper 5 which includes a motor 5a, and a motor mount 6 and a fan motor 7 with fan blades 7a. When the exterior wall-mounted fan assembly 3 is operational, the damper 5 is opened by damper motor 5a to permit air to enter into the pie-shaped air chamber 46 while fan motor 7 and fan propeller blades 7a are operational to move air 22 into the pie-shaped air chamber 46. The air 22 in the pie-shaped air chamber 46 is under pressure caused by the operation of the fan motor 7, fan propeller blades 7a of the exterior wall-mounted fan assembly 3 and the open damper 5 and damper motor 5a, so as to cause the air 22 to flow through the windows 11 and 11a, in the walls 2 and 2a, into the cell modules 10 and 20 of the cell module 1. The modular unit 1 is divided by a chase wall 10 in the center of the cell module 1, thereby partitioning the modular unit 1 into modular cell 10 and modular cell 20. If desired, a shield 55 and 55a denies communication, visual and otherwise, between modular cell 10 and modular cell 20, but without inhibiting the flow of air 22 into modular cell 10 and modular cell 20. The air 22 and 22a moves into modular cells 10 and 20 to circulate therein and enters through a window 18 and window 18a and into the chase areas 60.

The air 22 and 22a in the modular cells 10 and 20 of the modular units 1 may also enter the chase areas 60 through screened windows 16 and 17 in the cabinet 13 which includes the commode 15 and sink 14.

Disposed within the chase areas 60 are smoke detectors 40 and other pipes and wires not shown. Disposed above the chase areas 60 of modular units 1 and air chambers 46 is a roof 21 having a number of roof openings 21a. In each roof opening 21a in the roof 21 there is an exhaust fan assembly 26, each exhaust fan assembly 26 includes an exhaust fan 29 with blades 29a which are supported by a motor mount 28. The motor mount 28 fits into a rectangular opening 25 which is disposed over a roof opening 21a. Disposed within the rectangular opening 25 is a second motorized damper 27 which is operated by an electric motor 27a. The second motorized damper 27 is operational only when the exhaust fan 29 is operational and, conversely, the second motorized damper 27 is closed when the exhaust fan 29 is not operational. The exhaust fan assembly 26 includes a cap 30 which protects the exhaust fan 29, damper 27 and damper motor 27a from the elements. Thus in that manner, the removal of smoke-filled air 22 and 22a is done in a push and pull form of action by the outside wall fan 7 and the exhaust fan 29.

Figure 8:
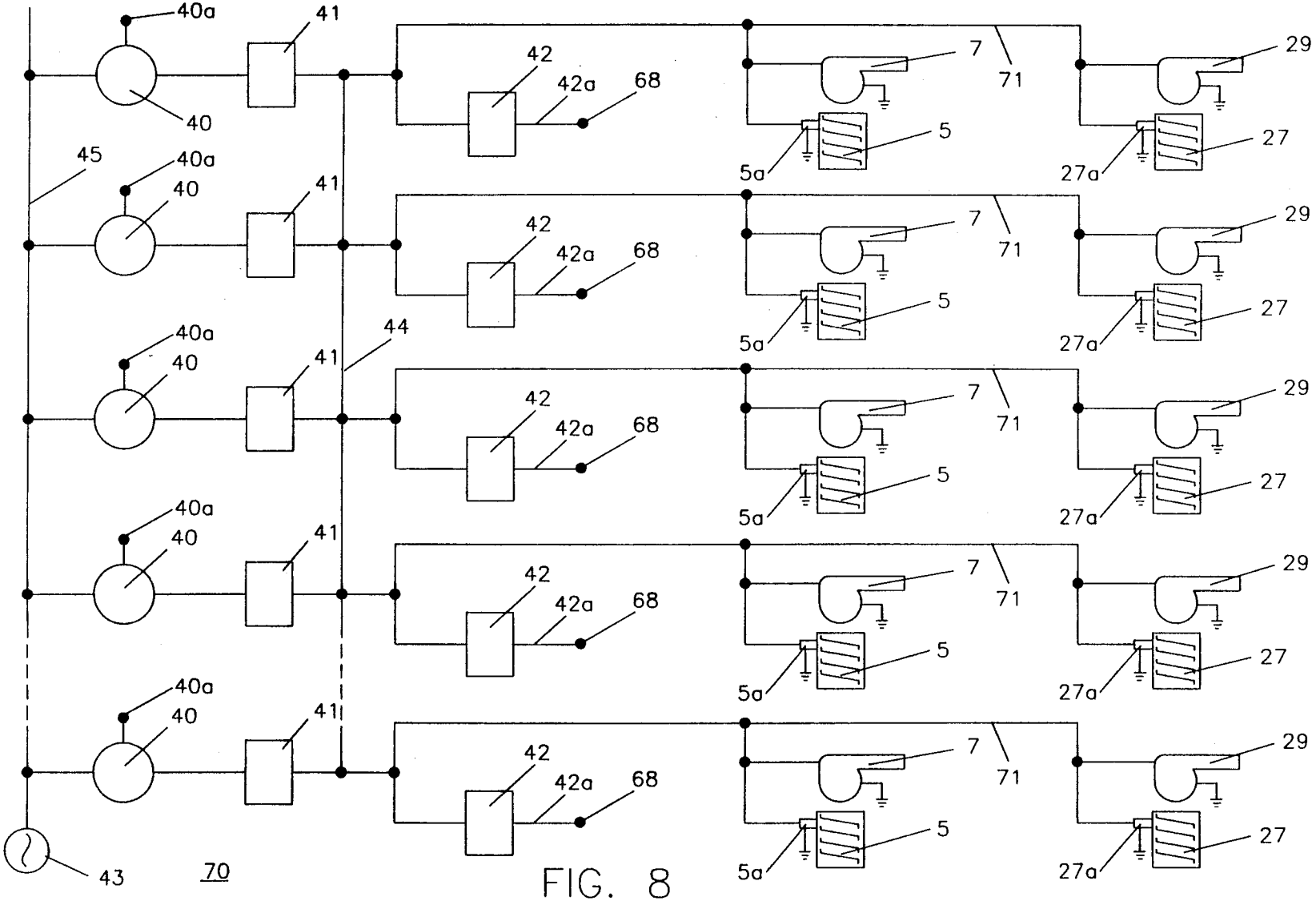
FIG. 8 is a schematic diagram of the smoke detector circuit contained by the smoke evacuation system servicing the modular units of the prison complex.

Referring to FIG. 8, a schematic diagram of the smoke detector circuit 70 is shown. The smoke detector circuit 70 includes the smoke detectors 40 and an associated indicator light 40a to show when a particular smoke detector 40 is fired because of smoke in its presence. Referring to FIG. 5 and FIG. 8, a smoke detector circuit 70 is provided for each section, body sections 31, 32, 33, 34, 35 and 36, of the prison complex 50. Said sections 31, 32, 33, 34, 35 and 36 of the prison complex 50 are respectively set off from each other and, therefore, said sections 31, 32, 33, 34, 35 and 36 are respectively isolated from each other. Accordingly, we now describe the smoke detector circuit 70 as found in section 31 of the prison complex 50, section 31 includes two (2) levels of modular units 1 with cell modules 10 and 20 in each modular unit 1. Each modular 1 includes modular cells 10 and 20, placed one upon another, and a chase area 60. Thus section 31 has five (5) chase areas with 16 modular cells 10 and 20, and includes five (5) pie-shaped air chambers 46 serving the 16 modular cells 10 and 20. A smoke detector 40 is disposed in each of the five (5) chase areas 60 and each smoke detector 40 is connected to the smoke detector circuit 70. Each smoke detector 40 includes an indicator light 40a and a relay 41. The relay 41, when energized by the smoke detector 40, locks in the voltage source 43 of that particular smoke detector 40 onto a display light 40a, and thereby distributes electricity from the voltage source 43 to all of the relays 42 which turns off the voltage at point 68. At point 68 the heating and air conditioning unit (not shown) is connected to relay 42 for the modular units 1, so that when relay 42 is energized, then the circuit 42a is opened at point 68. At the same time wall fan 7 and damper motor 5a are both turned to the "on" position by the closing of circuit 71, and also at the same time exhaust fan 29 and damper motor 27a are also turned on so that each chase area 60 now has its respective wall fan 7 and exhaust fan 20 turned on to evacuate smoke from all modular units 1 contained in the section 31 of the prison complex 50. When wall fan 7 and exhaust fan 29 are turned on, there is created the push-pull form of action to withdraw smoke from the modular cells 10 and 20 and the chase area 60.

A detector circuit 70 shown in FIG. 8 which serves section 31 of the prison complex 50 may also be provided for each section 32, 33, 34, 35 and 36 of the prison complex 50. It should be noted that the indicator lights 40a may be mounted on a display unit 65 shown in FIG. 5.

Having thus described the invention, it will be evident that other modifications and improvements may be made by one skilled in the art which will come within the scope of the annexed claims. For example, the smoke evacuation system may be utilized in a different configuration of a prison complex not shown. Another example may be found in a rectangular prison complex not shown which is divided into a chase area not shown and a air chamber for the smoke detector circuit not shown.

What is claimed is:

1. A smoke evacuation system for a building constructed of modular units comprising:

(a) air intake chambers defined by the spaces between a pair of modular units disposed to each other, and at least a single wall joining each pair of said modular units;

(i) said single wall of each said air intake chamber having an opening therein;

(b) an air intake fan mounted in said opening of each said single wall of each said air intake chamber for drawing air into said air intake chamber;

(c) a first window opening in each said modular unit;

(i) said first window opening in an individual said modular unit communicates with the modular unit's own said air intake chamber for the flow of air therethrough;

(d) a chase inside each said modular unit;

(i) each modular unit includes a second window opening;

(ii) said second window opening in an individual said modular unit communicates with the modular unit's own said chase for the flow of air therethrough;

(e) a roof covering each said modular unit, said chase and said air intake chamber;

(i) said roof having a roof opening disposed over each said chase;

(f) an exhaust fan mounted in each said roof opening for expelling smoke-filled air therethrough; and (g) smoke detector circuits including smoke detectors respectively mounted in each said chase for detecting the presence of smoke in each said chase and each said modular unit for closing any of the said smoke detector electrical circuits, when smoke is present therein, to thereby cause said exhaust fan and said air intake fan in any smoke-filled modular unit to operate; and for opening any said smoke detector electrical circuit, when smoke is not present in any said modular unit, so as to prevent any said exhaust fan and its corresponding said air intake fan from operating.

2. The smoke evacuation system defined in claim 1, further including;

(a) first motorized dampers, one of each mounted in each said opening of each said single wall of each said air intake chamber;

(i) each of said first motorized dampers being respectively connected to each said smoke detector circuit for each said air intake fan, so as to be respectively activated by said smoke detectors;

(b) second motorized dampers, one of each mounted in each said roof opening of said roof;

(i) said second motorized dampers, one of each being mounted to one of each said air exhaust fans, for controlling the flow of air out of each said modular unit and each said chase; and (ii) said second motorized dampers being respectively connected to said smoke detector circuits so as to be respectively activated by said smoke detectors.

3. A smoke evacuation system for a building including pairs of modular units, joined by at least one wall, which are disposed to each other so as to allow the passage of air through the spaces between said modular units comprising:

(a) Each said wall joining said modular units having an opening therein;

(b) an air intake fan mounted in said opening in each said wall joining said modular units for drawing air into said spaces between said modular units;

(c) a first window opening in each said modular unit;

(i) said first window opening in each said modular unit of each said pair of modular units communicates with the said space between said pair of modular units for the flow of air therethrough;

(d) a chase inside each said modular unit of each said pair of modular units;

(e) each modular unit each said pair of modular units includes a second window opening communicating with said chase for the flow of air therethrough;

(f) a roof covering each said building and all said pairs of modular units and the respective said spaces therebetween;

said roof having a roof opening disposed over each said chase for the flow of air therethrough;

(g) an exhaust fan mounted in each said roof opening for expelling smoke-filled air therethrough; and (h) smoke detector circuits including smoke detectors respectively mounted in each said chase for detecting the presence of smoke in each said chase and each said modular unit of each said pair of modular units for closing any of the said smoke detector electrical circuits, when smoke is present therein, to thereby cause said exhaust fan and said air intake fan in any smoke-filled modular unit to operate; and for opening any said smoke detector electrical circuit, when smoke is not present in any said modular unit, so as to prevent any said exhaust fan and its corresponding said air intake fan from operating.

4. The smoke evacuation system defined in claim 3, further including:

(a) first motorized dampers, one of each mounted in each said opening of each said said single wall;

(i) each of said first motorized dampers being respectively connected to each said smoke detector circuit for each said air intake fan, so as to be respectively activated by said smoke detectors;

(b) second motorized dampers, one of each mounted in each said roof opening of said roof;

(i) said second motorized dampers, one of each being mounted to one of each said air exhaust fans, for controlling the flow of air out of each said modular unit and each said chase; and (ii) said second motorized dampers being respectively connected to said smoke detector circuits so as to be respectively activated by said smoke detectors.

* * * * *